United States Patent [19]

Vittone

[11] Patent Number: 4,889,445

[45] Date of Patent: Dec. 26, 1989

[54] EXPANSION JOINT FOR SETTABLE COMPOSITIONS

[76] Inventor: Larry W. Vittone, 309 Hannah Dr., Oliver Springs, Tenn. 37840

[21] Appl. No.: 231,729

[22] Filed: Aug. 12, 1988

[51] Int. Cl.[4] ..... E01C 11/10

[52] U.S. Cl. ..... 404/64; 404/69

[58] Field of Search ..... 404/47, 48, 49, 64–69; 14/16.5; 52/396, 403, 573

[56] References Cited

U.S. PATENT DOCUMENTS

| | | | |
|---|---|---|---|
| 1,089,943 | 3/1914 | Morse et al. | 404/69 |
| 1,880,725 | 10/1932 | Bleck | 404/48 |
| 2,100,238 | 11/1937 | Burgess | 404/49 X |
| 3,297,294 | 1/1967 | Middlestadt | 404/47 X |
| 3,352,217 | 11/1967 | Peters et al. | 404/65 |
| 3,508,369 | 4/1970 | Tennison | 52/396 |
| 3,871,787 | 3/1975 | Stegmeier | 52/396 X |
| 3,967,911 | 7/1976 | Miers | 404/48 |
| 3,971,075 | 7/1976 | Heinbaugh et al. | 4/172.19 |
| 4,050,206 | 9/1977 | Utsuyama | 404/48 X |
| 4,067,155 | 1/1978 | Ruff et al. | 52/105 |
| 4,090,800 | 5/1978 | Koch | 404/48 |
| 4,548,009 | 10/1985 | Dahowski | 52/396 |

FOREIGN PATENT DOCUMENTS

| | | | |
|---|---|---|---|
| 166719 | 1/1986 | European Pat. Off. | 404/68 |
| 661080 | 3/1938 | Fed. Rep. of Germany | 404/64 |
| 1427163 | 12/1966 | France | 404/64 |
| 2307091 | 11/1976 | France | 52/396 |

*Primary Examiner*—Jerome W. Massie, IV
*Assistant Examiner*—Matthew Smith
*Attorney, Agent, or Firm*—Luedeka, Hodges & Neely

[57] ABSTRACT

An expansion joint for settable compositions such as concrete and the like comprises a base portion which is embedded in the composition before it sets with its upper surface adjacent the surface of the composition, and a cover portion which is engagingly received in a slot defined by the removal of a portion of the upper surface of the base portion after the composition hardens around the base. The cover portion is sufficiently wide to cover gaps in the composition adjacent the edge of the base portion. Two or more base portions may be secured together to provide an expansion joint to variable depths in the composition.

17 Claims, 1 Drawing Sheet

EXPANSION JOINT FOR SETTABLE COMPOSITIONS

The invention relates to expansion joints for use with settable compositions such as concrete, and more particularly relates to expansion joints that are placed in the composition before it hardens.

Expansion joints are used with most settable compositions poured in a slab form, such as concrete and the like, to prevent surface cracks due to expansion and contraction of the concrete as a result of environmental changes. Typically, the joints are provided by elongate strips of wood or plastic. The strips are either put in place prior to pouring the concrete or they are pressed down into the concrete immediately after the screeding process, with the surface of the joint substantially level with the surface of the concrete.

Typically, existing plastic joints have a protective peel off tape which protects the joint from damage during surface finishing steps and separates the top surface of the joint from any concrete which may be pushed over the joint during finishing.

After the surface of the concrete is finished, and the concrete has set, the tape is pulled up revealing the joint. Often, there is a significant thickness of concrete on the tape and, when it is pulled up, chips of concrete are also pulled up adjacent the edge of the tape and the joint leaving an unattractive jagged edge. This is particularly undesirable in decorative installations such as swimming pools, patios, etc.

Accordingly, it is an object of the present invention to provide an expansion joint for use in settable compositions such as concrete and the like.

A further object of the invention is the provision of an expansion joint of the character described which eliminates the need for tape over the joint.

Another object of the invention is the provision of an expansion joint for use in settable compositions such as concrete and the like which is configured to substantially cover the edge of the concrete abutting the joint so that any chips or other unattractive surface deviations in the concrete adjacent the joint are substantially hidden from view.

Yet another object of the invention is the provision of an expansion joint of the character described which can be made to extend to varying depths in the concrete.

An additional object of the invention is to provide an expansion joint of the character described which covers the concrete abutting on either side of the joint to cover chips present in the concrete adjacent the joint.

Still another object of the invention is the provision of an expansion joint of the character described which is manufactured of inexpensive, readily available materials using conventional manufacturing techniques.

A still further object of the invention is the provision of an expansion joint of the character described which is aesthetically desirable and is adapted for a wide range of uses, and which offers functional advantages over known expansion joints.

These and other objects and advantages of the present invention will become further known with reference to the following detailed description in conjunction with the accompanying drawings in which.

Figure 1:
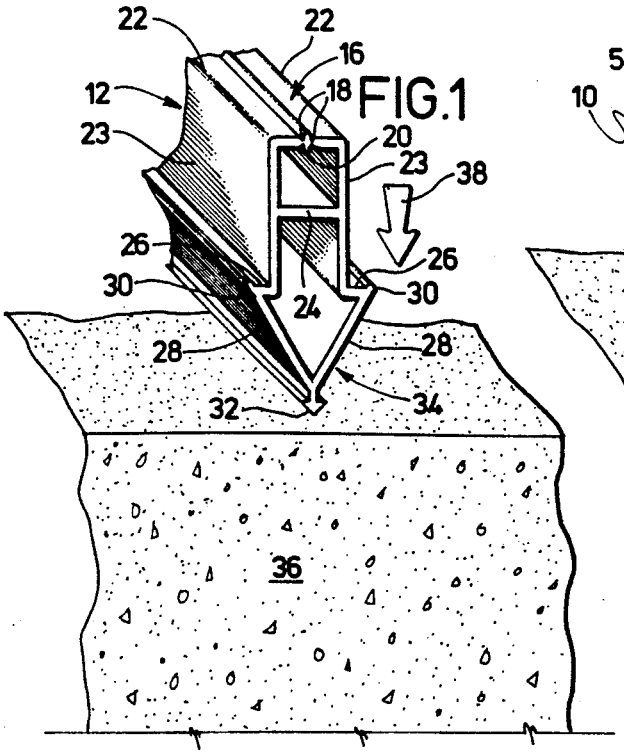
FIG. 1 is a fragmentary perspective view, partially in section, illustrating a base portion for use in an expansion joint constructed in accordance with a preferred embodiment of the present invention, the base being situated above a mass of concrete within which the base will be embedded.

In accordance with its more general aspects, the present invention includes an expansion joint for placement in the surface of a plastic composition settable into a hard mass, such as concrete and the like. The joint comprises an elongate base portion for being embedded in the composition while the composition is in its plastic state. The base portion has an upper surface extending along its length for being positioned adjacent the surface of the composition, and at least a portion of the upper surface is separable therefrom along its length to provide a slot in the upper surface running generally along the length of the base portion and opening to the space above the surface of the composition with edges of the concrete being adjacent the upper surface of the base portion.

The base portion also has a lower end for placement in the composition below the surface. The lower end is configured to project into the adjacent composition in such a manner as to restrict upward displacement of the base portion from the composition once it sets.

The joint further comprises an elongate cover portion generally T-shaped in cross section to define a cross bar having lateral end edges and a projection depending from the cross bar approximately midway between its end edges, and disposed generally perpendicular to the cross bar. The cross bar defines a pair of flanges outwardly disposed relative to the projection and terminating in the end edges.

The projection is configured together with the slot so that the projection is engagingly received in the slot to secure the cover portion to the base portion and the flanges are configured to extend beyond the edges of the concrete adjacent the upper surface of the base portion when the projection is received therein. As a result, the base portion may be placed into the settable composition with the upper surface disposed adjacent the surface of the composition and, after the composition has set, the portion of the upper surface may be separated therefrom to provide the slot, and the cover may be secured to the base portion by placing the projection into the slot so that the projection is engagingly received therein, the flanges extending beyond the edges of the composition adjacent the upper surface to cover the edge of the composition adjacent the upper surface.

With the expansion joint of the present invention, the need to provide tape on the upper surface of the joint is eliminated. Concern over deterioration of the upper surface of the joint by surface finishing is also alleviated because the cover can be applied after finishing is completed. Additionally, it is not a significant problem in the expansion joint of the present invention to have a portion of the concrete spread over the upper surface of the base portion during finishing. This is because the portion of the upper surface of the base portion which is pulled up defines the slot in which the projection of the cover is received. Thus, there is no need to have the upper surface of the base portion itself uncovered by the concrete. Furthermore, even though some bits of concrete may be dislodged as the separable portion is removed from the upper surface of the base, the gaps left thereby will be covered by the outwardly disposed flanges of the cover portion. Thus, it can seen that the expansion joint of the present invention offers numerous functional and aesthetic advantages over known expansion joints.

Another advantage of the present invention is the provision of an expansion joint which can be made to extend to varying depths in the composition. This is provided by configuring the lower end of the base portion together with the slot so that the lower end is engagingly received in the slot of another base portion. Thus, a plurality of base portions may be secured together one atop the other to provide an expansion joint to varying depths in the composition.

Referring now to the drawings in which like reference characters designate like or corresponding parts throughout the several views, features of an expansion joint 10 constructed in accordance with a preferred embodiment of the present invention are illustrated in FIGS. 1 through 4. The joint 10 will be described in connection with its use in concrete but it will be appreciated that the joint will find application in most any settable composition.

Figure 2:
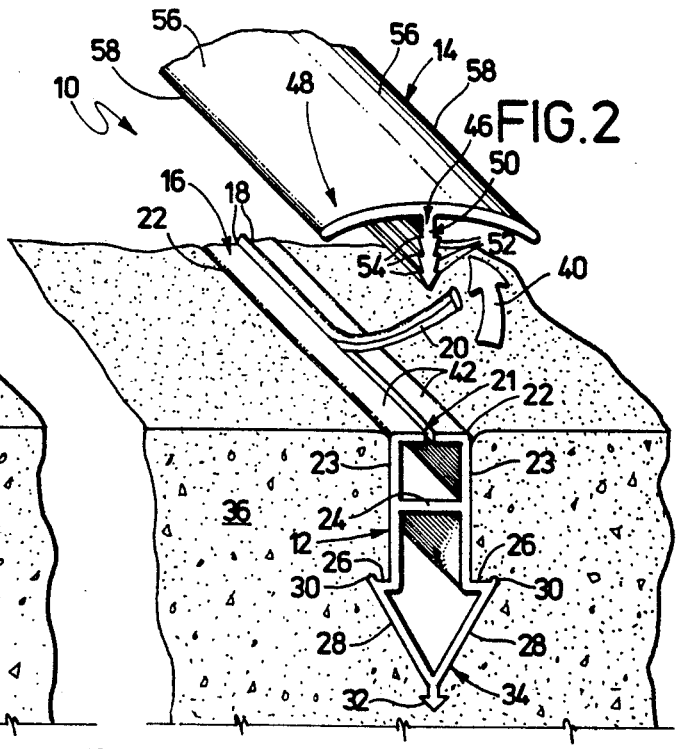
FIG. 2 is a fragmentary perspective view, partially in section, showing the base portion embedded within the concrete and a cover portion forming a part of the joint of the present invention situated above the base.
Figure 3:
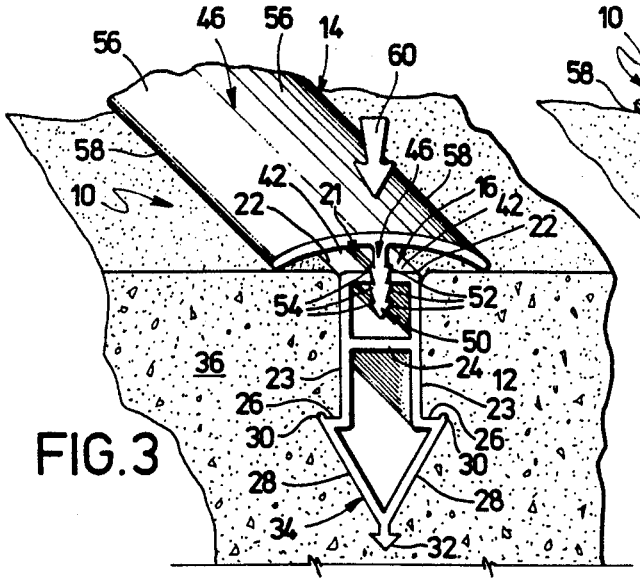
FIG. 3 is a fragmentary perspective view, partially in section, showing the cover portion secured to the base portion.
Figure 4:
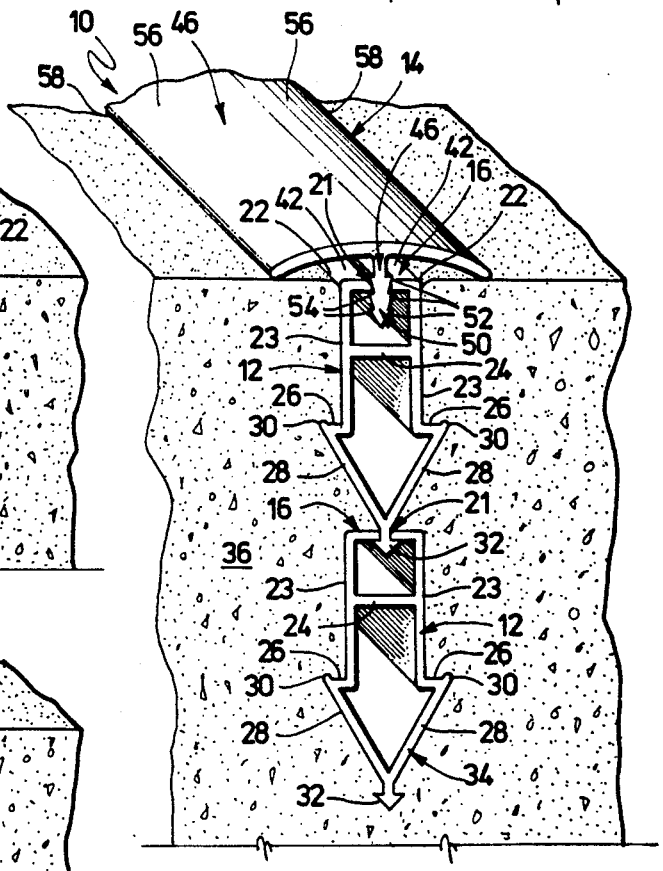
FIG. 4 is a fragmentary perspective view as in FIG. 3 but with two base portions secured together and embedded in concrete.

The joint 10 comprises a base portion 12 for being embedded in the concrete and a cover portion 14, the latter of which is shown in FIGS. 2 through 4. The base portion 12 will be described first.

As is shown in FIG. 1, the base portion 12 is preferably an integral construction comprising an upper surface 16 extending along its length. Preferably, the upper surface 16 is substantially flat.

In the preferred embodiment, the upper surface 16 is scored along two spaced apart lines 18 that run the length of base portion 12 and are situated such that a section 20 between scored lines 18 is located substantially in the middle of surface 16. The lines 18 represent areas of reduced thickness in the surface 16 to facilitate ready separation of the section 20 of the surface 16 from the remainder thereof to define a slot 21 for a purpose described below.

Extending down from each opposite lateral edge 22 of surface 16 is a generally planar side wall 23. A bridge 24 extends between the inner surfaces of the side walls 23 at a location spaced below the top surface 16 to impart structural integrity to base portion 12.

Flanges 26 project out from the lower ends of the side walls 23 and extend the length of base portion 12 to restrict upward displacement of the base portion 12 from the concrete. Lower walls 28 extend down from outer edges 30 of flanges 26 and converge together at point 32. The lower walls 28 and point 32 together define a bottom surface 34 of the base portion 12.

The cover portion 14 is elongate corresponding to the base portion 12, is generally T-shaped in cross section, and has a projection generally indicated at 46 and a cross bar 48.

In a preferred embodiment, the projection 46 comprises a stem 50 which defines a plurality of longitudinal beads 52 connected one to another in a side-by-side, generally parallel relationship. Preferably, the beads 52 have an arrowhead configuration in cross section as illustrated in the drawings. The stem 50 has portions 54 of reduced thickness adjacent the beads 52. Each bead 52 is preferably wider than slot 21 and the portions 54 of reduced thickness adjacent the beads are preferably no wider than the slot 21.

The cross bar 48 extends the length of cover portion 14 and has a pair of flanges 56 outwardly disposed relative to projection 46 and terminating in end edges 58. Preferably, the cross bar 48 is arcuate in configuration.

Both the base portion 12 and the cover portion 14 may be manufactured of extruded thermoplastic material. The thermoplastic may contain additives to resist the corrosive nature of the concrete 36 and additionally may contain additives to resist traffic wear. Coloring may also be added, particularly to the cover portion 14, and luminescent substances can be added where this feature is desirable such as in the use of the joint in roadways and the like or to provide a special effect in darkness.

In use, the base portion 12 is typically placed into a mass of concrete 36 still in its plastic state after preliminary screeding operations have been performed. This is accomplished by forcing the base 12 down into the concrete 36 in the direction of arrow 38 until it is substantially embedded in the concrete with the upper surface 16 substantially level with the surface of the concrete 36. After the base 12 is positioned, final finishing is completed so that the surface of the concrete has the desired appearance.

The concrete is then permitted to set and the flanges 26 serve to anchor the base portion 12 in position.

The section 20 is then removed from base portion 12 in the direction of arrow 40 revealing a pair of opposed inwardly directing flanges 42 defining the edges of the slot 21 and extending the length of base portion 12 with the slot opening to the space above the surface of the concrete. It is preferred that during finishing, the edges of the concrete be maintained at the lateral edges 22 of the upper surface 16 and that the amount of concrete pushed over on the upper surface be minimized. However, even though a thin layer of concrete may extend over the upper surface and over the section 20 as a result of final finishing operations, this is of no real concern. The section 20 can still be located at the end of the base 12 and pulled up which would then open the slot 21 through the thin layer of concrete to the space above the concrete surface since the concrete above the section 20 would also come up. Thus, the edges of the concrete that are adjacent the upper surface 16 of the base portion 12 may, depending on the circumstances, be at the lateral edges 22 of the upper surface or they may be next to the edges of the slot 21. Preferably, the end edges 58 of the flanges 56 extend to beyond the lateral edges 22 of the upper surface 16 of the base 12 so that they will cover the concrete edges in either case.

Once the section 20 is removed from the base 12, the cover portion is secured to the base 12 by placing the projection 46 down into the slot 21 defined by removal of the section 20 as shown in FIG. 3, through the application a downward force in the direction of arrow 60. Because of their arrowhead configuration as described above, the beads 52 will engage the edges of the slot 21 when the stem 50 is pushed into the slot between the flanges 42. Since the base 12 is preferably made of plastic, the flanges 42 should yield to a degree under the downward force of the beads 52 permitting the same to move past the flanges into the slot 21 until downward pressure is released or the stem 50 has been inserted to the extent of its length. But, the barbs of the beads 52 will engage the bottom surface of the flanges 42 if an upward force is imposed on the stem 50 restricting removal of the cover portion 14 from the base portion 12. And, through proper design, the stem 50 and the beads 52 defined thereon can be configured such that the flanges 56 will engage the surface of the concrete adjacent the upper surface 16 of the base 12 with the edges of the flanges 42 defining the slot 21 engaging at least one of the beads, thereby engaging the cover 14 between the concrete 36 and the base 12 to provide a very secure and firm fit between the base 12 and cover 14.

As shown in FIG. 4, it is a feature of the present invention that two base portions 12 may be joined together to form an expansion joint assembly of variable depth. This is preferably accomplished by configuring the point 32 on the bottom surface 34 of the base 12 so that it has an arrowhead shape in cross section to define barbs which engage the underside of flanges 42 defined by removal of the section 20 from the upper surface 16 of another base portion 12. In actual use, the base portions 12 are preferably joined together prior to placement of the base portions 12 in the concrete. A cover portion 14 is then secured to the top of the upper base portion 12 in the now familiar fashion.

Figure 5:
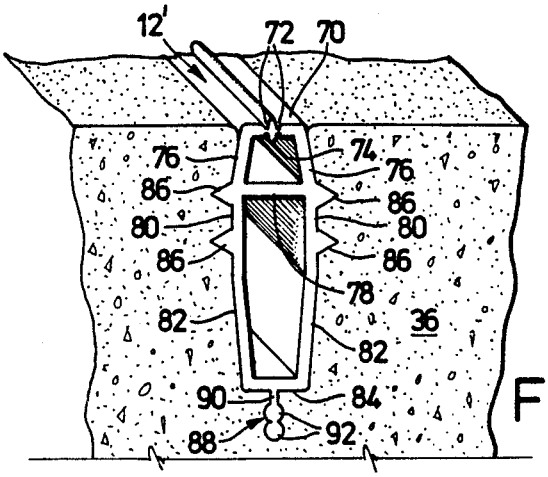
FIG. 5 is a fragmentary perspective view, partially in section, illustrating an alternate form of the base of FIGS. 1–4 with the base embedded within the concrete.

An alternate form of the base 12' is shown in FIG. 5. The base 12' is preferably an integral construction comprising an upper surface 70 extending along its length and, as in the base 12 of FIGS. 1 through 4, is preferably substantially flat. The surface 70 is scored along spaced apart lines 72 that run the length of the base 12' and are situated such that a section 74 between the lines is located substantially in the middle of the surface. The lines 72 represent areas of reduced thickness in the surface 70 to facilitate ready separation of the section 72 from the surface to provide a slot (not shown) in the same manner and for the same purpose as in the form of the base 12 of FIGS. 1–4 described above. In this regard, it is noted that the base 12' may be used with the cover 14 in the same manner as the base 12.

A pair of spaced apart, diverging upper side wall sections 76 extend down from the outer edges of the upper surface 70. A bridge 78 extends between the lower ends of the upper side wall sections 76. A pair of substantially parallel middle side wall sections 80 extend down from the lower ends of the upper side wall sections 76. Converging lower side wall sections 82 extend down from the lower ends of the middle side wall sections 80, and a substantially flat, horizontally disposed bottom surface 84 extends between the lower edges of the sections 82 to close the base 12'.

Projections 86 extend laterally outwardly from the base 12' adjacent the middle side wall sections 80 and are preferably triangular in cross-section, although any suitable configuration may be used to provide a projection which restricts upward displacement of the base 12' from the surrounding composition 36. Regarding the problem of upward displacement, a particularly advantageous feature of the base 12' is that the downwardly diverging upper side wall sections 76 provide a resistance to upward displacement of the base 12'. The concrete adjacent the sections 76 angles in slightly toward the upper surface 70 on each side of the base which becomes, in effect, wedged in the concrete to substantially prevent its vertical displacement.

A stem 88 projects from the bottom surface 84 and is configured to enable a multiple of bases 12' to be joined together atop one another in the manner of the point 32 described above on the base 12 of FIG. 4. The stem 88 includes a neck 90 and one or more beads 92 running along its length, preferably continuously. The neck preferably has a length approximately equal to the thickness of the upper surface 70 so that the upper surface of one base 12' will be engaged between the bottom surface 84 of the adjacent base and the bead closest to the bottom surface. And the width of the beads 92 is greater than the width of the slot formed by removal of the section 74 from the upper surface 70 so that the bead engages the underside of the upper surface after the stem 88 inserted into the slot.

One advantage of the configuration of the base 12' is the ease with which it may be inserted into the concrete while the concrete is in its plastic state. That is, the configuration owing to the gradual outward tapering of the lower side wall sections 82 permits a more narrow overall construction so that less concrete needs to be displaced as the base 12' is pushed downwardly. This also helps avoid the problem of "floating" which has plagued many prior art joints. Floating of the joint is further discouraged by the disposition of the upper side wall sections 76 described above.

It can be seen from the foregoing discussion that the present invention overcomes aesthetic drawbacks and functional problems associated with the construction and use of conventional expansion joints. The need for tape to cover the joint during final finishing is eliminated. And, any gaps or chips formed in the concrete when the section of the upper surface is removed are hidden by the flanges of the cover. The base and cover are also easily manufactured using conventional extrusion processes and with readily available, inexpensive materials.

Furthermore, the base and cover provide a convenient means by which intersections between adjacent lengths are accommodated in an aesthetically desirable fashion. For example, at the intersection between the ends of adjacent base portions such as at a T, the adjacent covers can be configured to meet and cover the abutting or closely adjacent base ends by cutting the ends of the covers off at 45° angles to provide an attractive, finished look.

Another advantage of the invention is that the base itself may be used as a support for screeding when large areas of concrete are being poured and it is necessary to divide the areas into smaller square or rectangular sections to permit screeding to be performed. In the past, this has been accomplished by placing form wood between the sections before the area is poured and then screeding off of the upper surface of the form wood which is substantially level with the upper surface of the outer concrete form, and thus the concrete surface. After the concrete begins to set, the form wood is removed leaving voids which must then be filled with concrete. With the joint of the present invention, the base can be wired to vertical rebar pieces driven into the subsurface before the concrete is poured with the top surface of the base and the top ends of the rebar substantially level with the upper surface of the outer form. When the sections are poured, the base provides a support to screed off of. After the concrete sets, the cover may be placed into the base as described in the foregoing so that a finished, attractive joint is provided between the sections without the need for internal form wood and its attendant disadvantages.

Although a preferred embodiment of the invention has been described in the foregoing detailed description, it will be understood that the invention is capable of numerous rearrangements, substitutions, and modifications without departing from the scope and spirit of the following claims.

What is claimed is:

1. An expansion joint for placement in the surface of a plastic composition settable into a hard mass comprising:

an elongate base portion for embedding in the composition while the composition is in its plastic state, said base portion having an upper section including opposite sides extending along the length of said upper section with said sides defining a pair of opposing parts collectively defining an upper surface of said base portion extending along the length of said upper section for positioning adjacent the upper surface of the composition when the base portion is operatively embedded therein, said opposing parts being separably joined to one another along a predetermined path oriented longitudinally of said base portion and extending along said upper surface so that the opposing parts can be separated from one another along said path so as to form a slot in said upper surface between said opposing parts extending generally along said path and along the length of said base portion and for opening to the space above the surface of the composition when said base portion is operatively embedded within the composition, said base portion further including a lower end for placement in the composition below the composition surface and configured to cooperate with the composition in such a manner as to restrict upward displacement of said base portion from the composition once it sets;

an elongate cover portion generally T-shaped in cross section to define a cross bar having lateral end edges and a projection depending from and disposed generally perpendicular to said cross bar, said cross bar defining a pair of cross bar flanged outwardly disposed relative to said projection and terminating in said lateral end edges; and said projection being of such size and shape so as to be received by the slot formed between said opposing parts when said opposing parts are separated from one another and engaged by said opposing parts when said projection is inserted into the slot through said upper surface to secure said cover portion to said base portion and said cross bar flanged being configured to extend out beyond the edges of the composition adjacent said upper surface when the projection is received by the slot, whereby said base portion may be placed into the settable composition with said upper surface disposed adjacent the surface of the composition and, after the composition has set, said opposing parts of said upper surface may be separated from one another to form the slot, and said cover portion may be secured to said base portion by placing said projection into the formed slot so that said projection is engagingly received therein, said cross bar flanges extending out beyond so as to cover the edges of the composition adjacent said upper surface when said cover portion is positioned within the formed slot.

2. The expansion joint of claim 1, wherein said lower end of said base portion is configured so as to be engagingly received by the slot of another base portion of like construction, whereby a plurality of base portions may be secured together one atop the other to provide an expansion joint to any desired depth in the composition.

3. The expansion joint of claim 1 or 2, wherein the slot is formable along the entire length of said upper surface.

4. The expansion joint of claim 1 or 2, wherein the slot formed by the separation of said parts from one another is linear.

5. The expansion joint of claim 1 or 2, wherein said projection is continuous along the length of said cover portion.

6. The expansion joint of claim 1 or 2, wherein said upper section of said base portion has a mid-section arranged between the sides of said upper section and extending along generally the length of said upper section, said mid-section being joined to said opposing parts along two spaced apart paths at which the upper section is of reduced thickness in comparison with the thickness of the remainder of said upper section, said spaced apart parts extending the length of said upper surface and spaced inwardly of said opposite sides of said upper section, said paths of reduced thickness providing weak lines to facilitate separation of the mid-section from the remainder of said upper section along said paths so that upon separation of said mid-section along said paths as aforesaid, said opposing parts are separated from one another and the slot is formed therebetween.

7. The expansion joint of claim 1 or 2, wherein said lines are continuous and generally linear.

8. The expansion joint of claim 1 or 2, wherein said lines comprises scoring.

9. The expansion joint of claim 1 or 2, wherein said upper surface has a width as viewed in elevation and the combined width of said cross bar flanges exceeds the width of said upper surface.

10. The expansion joint of claim 9, wherein said upper surface is flat.

11. The expansion joint of claim 9, further comprising:

said base portion including spaced apart generally planar side walls providing said opposite sides of said base portion and having upper and lower ends, said upper surface being generally flat and extending between said upper ends of said side walls and arranged generally perpendicular to said side walls;

flanges extending laterally outwardly from adjacent said lower ends of said side walls for projecting into the settable composition to restrict upward movement of said base portion therefrom;

lower walls extending from said laterally-extending flanges and converging together to define a bottom surface of said base portion; and a bridge extending between inner surfaces of said side walls to impart structural integrity to the base portion.

12. The expansion joint of claim 1 or 2, wherein said projection comprises a stem defining a plurality of longitudinal beads connected one to another in a side-by-side, generally parallel relationship so that the stem is reduced in thickness between adjacent beads, each of said beads possessing a width which is greater than the width of the formable slot and the areas of reduced thickness between adjacent beads possessing a width which is substantially equal to or less than the width of the formable slot so that said opposing parts of said upper section engage said stem between adjacent beads when said stem is operatively inserted within the slot, when formed; and said cross bar flanges of said cover portion are resiliently deflectable in a direction generally opposite to their orientation relative to said stem, said stem and the beads defined thereon being configured together with said cross bar flanges so that engagement of said opposing parts of said upper section by said stem areas of reduced thickness urges said cross bar flanges into contact with the surface of the composition adjacent said upper surface of said base portion thereby imposing a deflection force on said cross bar flanges so that said cover portion is held within the formed slot of said base portion with its cross bar flanges in a deflected condition.

13. The expansion joint of claim 1 or 2, wherein said base portion and said cover portion each are an integral construction comprising an extruded thermoplastic material.

14. The expansion joint of claim 13, wherein said thermoplastic material contains additives to resist corrosion by contact with the settable composition.

15. The expansion joint of claim 13, wherein said thermoplastic material contains additives to resist traffic wear.

16. An expansion joint for placement in the surface of a plastic composition settable into a hard mass, such as concrete and the like, comprising:

an elongate base portion for being embedded in the composition while the composition is in its plastic state, said base portion having a flat upper surface extending along its length for being positioned level with adjacent the surface of the composition so that edges of the composition are adjacent opposite lateral edges of said upper surface, having spaced apart generally planar side walls having upper and lower ends, said upper surface extending between said upper ends of said side walls generally perpendicular to said walls, having flanges extending laterally outward from adjacent said lower ends of said side walls for projecting into the settable composition to restrict upward movement of said base portion, and having lower walls extending from said flanges and converging together to define a bottom surface of said base portion;

an elongate cover portion generally T-shaped in cross section to define a cross bar having lateral edges and a projection depending from said cross bar approximately midway between its end edges and generally perpendicular to said cross bar, said cross bar defining a pair of flanges outwardly disposed to said projection and terminating in said end edges;

said upper surface having a thickness and running the length of said base portion, and at least a portion of said upper surface being separable therefrom along its length to provide a slot in said upper surface running the length of said upper surface, said section of said upper surface that is separable therefrom being integral with said upper surface and being defined between spaced apart lines of reduced thickness running the length of said upper surface and spaced inwardly of said opposite lateral side edges of said upper surface, said lines providing weak lines to facilitate separation of the section of said upper surface located therebetween from the section of said upper surface outside said lines and, upon separation of the section between said weak lines from the upper surface, said lines corresponding to the position of marginal edges of inwardly projecting flanges terminating at said lines and defining the width of said slot;

said projection comprising a stem, said stem defining a plurality of longitudinal beads connected one to another in a side-by-side, generally parallel relationship so that said stem is reduced in thickness between adjacent beads, each of said beads being wider than said slot and the areas of reduced thickness between adjacent beads being no wider than said slot so that said stem is engagably received between said marginal edges of said flanges to secure said cover portion to said base portion;

said flanges of said cover portion being resiliently deflectable in a direction generally opposite to their orientation relative to said stem, said stem and the beads defined thereon being configured together with said flanges so that engagement of said marginal edges of said inwardly directed flanges of said upper surface of said base portion between two adjacent beads places said flanges of said base portion in contact with the surface of the composition adjacent said side edges of said upper surface imposing a deflection force on said flanges; and said lower end of said base portion being configured together with said slot so that said lower end is engagingly received in the slot of another base portion so that a plurality of base portions may be secured together one atop the other to provide an expansion joint to a variable depth in the composition, whereby said base portion may be placed into the settable composition with said upper surface disposed level with the surface of the composition and, after the composition has set, said section of said upper surface may be separated from said upper surface of said base portion to provide said slot, and said cover portion may be secured to said base portion by placing said projection into said slot so that said stem is engagingly received therein, said flanges extending beyond the edges of the composition adjacent the opposite lateral edges of the upper surface of said base portion to cover the composition adjacent the upper surface of said base portion.

17. An expansion joint for placement in the surface of a plastic composition settable into a hard mass comprising:

an elongate base portion for embedding in the composition while the composition is in its plastic state, said base portion having an upper surface extending along its length for positioning adjacent the surface of the composition, at least a portion of said upper surface being separable along its length from the remainder of said upper surface to provide slot means in said upper surface running generally along the length of said base portion and for opening to the space above the surface of the composition when said base portion is operatively embedded within the composition with edges of the composition being adjacent said upper surface, and a lower end for placement in the composition below the surface and configured to project into the adjacent composition in such a manner as to restrict upward displacement of said base portion from the composition once it sets;

an elongate cover portion generally T-shaped in cross section to define a cross bar having lateral end edges and a projection depending from said cross bar approximately midway between its end edges and disposed generally perpendicular to said cross bar, said cross bar defining a pair of cross bar flanges outwardly disposed relative to said projection and terminating in said end edges;

said projection being of such size and shape so as to be engagably received by said slot means to secure said cover portion to said base portion and said cross bar flanges being configured to extend out beyond the edges of the composition adjacent said upper surface when the projection is received by said slot means whereby said base portion may be placed into the settable composition with said upper surface disposed adjacent the surface of the composition and, after the composition has set, said upper surface may be separated in two to provide said slot means, and said cover portion may be secured to said base portion by placing said projection into said slot means so that said projection is engagingly received therein, said cross bar flanges extending out beyond so as to cover the edges of the composition adjacent said upper surface when said cover portion is positioned within the provided slot means; and is positioned within the provided slot means; and said upper surface having a thickness and being generally flat, and said portion of said upper surface that is separable from the remainder of said upper surface is defined between spaced apart lines of reduced thickness running the length of said upper surface and spaced inwardly of opposite lateral side edges of said upper surface, said lines providing weak lines to facilitate separation of said separable portion of said upper surface from the remainder of said upper surface and, upon separation of said separable portion from the remainder of said upper surface so as to form a slot in said upper surface corresponding in width to the spacing of said weak lines for receiving said projection of said cover portion so that when said projection is received by said slot, the sides of said slot engage said projection so as to secure said cover portion to said base portion.

* * * * *

UNITED STATES PATENT AND TRADEMARK OFFICE

CERTIFICATE OF CORRECTION

PATENT NO. : 4,889,445

DATED : December 26, 1989

INVENTOR(S) : Larry W. Vittone

It is certified that error appears in the above-identified patent and that said Letters Patent is hereby corrected as shown below:

Column 6, line 15, after 88 insert -- is --.

Column 8, line 24, after apart delete "parts" and insert -- paths --

Column 7, line 43, "flanged" should be -- flanges --.

Column 7, line 53, "flanged" should be -- flanges --.

Signed and Sealed this

Fourth Day of December, 1990

*Attest:*

*Attesting Officer*

HARRY F. MANBECK, JR.

*Commissioner of Patents and Trademarks*